US011259626B2

(12) United States Patent
Balestrini

(10) Patent No.: US 11,259,626 B2
(45) Date of Patent: Mar. 1, 2022

(54) PERSONAL CARE DEVICE

(71) Applicant: KONINKLIJKE PHILIPS N.V., Eindhoven (NL)

(72) Inventor: Luigi Balestrini, Zuidhorn (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 278 days.

(21) Appl. No.: 16/603,672

(22) PCT Filed: Apr. 9, 2018

(86) PCT No.: PCT/EP2018/058976
§ 371 (c)(1),
(2) Date: Oct. 8, 2019

(87) PCT Pub. No.: WO2018/192788
PCT Pub. Date: Oct. 25, 2018

(65) Prior Publication Data

US 2020/0113322 A1 Apr. 16, 2020

(30) Foreign Application Priority Data

Apr. 17, 2017 (EP) ..... 17000644

(51) Int. Cl.
*A46B 15/00* (2006.01)
*A46B 7/04* (2006.01)
(Continued)

(52) U.S. Cl.
CPC ..... *A46B 15/0006* (2013.01); *A46B 7/04* (2013.01); *A46B 13/008* (2013.01);
(Continued)

(58) Field of Classification Search
CPC ..... A47K 7/04; A47K 7/043; A61C 17/221; A46B 7/04; A46B 15/004; A46B 15/006
See application file for complete search history.

(56) References Cited

U.S. PATENT DOCUMENTS 5,274,735 A 12/1993 Okada
5,367,599 A 11/1994 Okada
(Continued)

FOREIGN PATENT DOCUMENTS

CN 203282503 U 11/2013
CN 205043823 U 2/2016
(Continued)

OTHER PUBLICATIONS

International Search Report and Written Opinion dated Jun. 5, 2018 for International Application No. PCT/EP2018/058976, Filed Apr. 9, 2018.

*Primary Examiner* — Shay Karls

(57) ABSTRACT

This invention relates to a device (1) for performing personal care operations on a subject. The device (1) comprises a handheld base body (3), a driving unit (400) to receive and drive an interchangeable treatment head (2) to perform the personal care operation, a sensor (7) for measuring the amount of current drawn from a motor arrangement (5, 6) while the driving unit (400) is being operated. The device (1) further comprises a control unit (8) operably connected to the sensor (7) and the driving unit (400) and configured to control the driving unit (400). The control unit (8) is configured to identify the individual treatment head (2) fitted on the driving unit (400) by comparing the measured motor current at the predefined measuring time (t1) with at least one predefined current threshold (C).

14 Claims, 3 Drawing Sheets

(51) Int. Cl.

| | |
|---|---|
| ***A46B 13/00*** | (2006.01) |
| ***A46B 13/02*** | (2006.01) |
| ***A47K 7/04*** | (2006.01) |
| ***A61H 7/00*** | (2006.01) |
| ***A61H 23/02*** | (2006.01) |

(52) U.S. Cl.
CPC ..... *A46B 13/023* (2013.01); *A47K 7/043* (2013.01); *A61H 7/005* (2013.01); *A61H 23/0254* (2013.01)

(56) References Cited

U.S. PATENT DOCUMENTS

| | | | | |
|---|---|---|---|---|
| 6,930,484 | B2 | 8/2005 | Wohlrabe | |
| 7,446,495 | B2 | 11/2008 | Tse | |
| 7,703,209 | B2 | 4/2010 | Freund | |
| 8,667,692 | B2 | 3/2014 | Kraus | |
| 8,832,944 | B2 | 9/2014 | Liao | |
| 8,943,635 | B2 | 2/2015 | Heil | |
| 9,295,477 | B2 | 3/2016 | Schneider | |
| 9,325,265 | B2 | 4/2016 | Suzuki | |
| 9,427,294 | B2 | 8/2016 | Klemm | |
| 2017/0049278 | A1 * | 2/2017 | Thomassen | A46B 7/04 |

FOREIGN PATENT DOCUMENTS

| | | | | |
|---|---|---|---|---|
| CN | 105078728 B | * 10/2020 | | A46B 5/0095 |
| EP | 3782509 A1 | * 2/2021 | | A46B 5/0095 |
| KR | 1999043453 | 6/1999 | | |
| WO | 2015/169606 | 11/2015 | | |
| WO | WO-2015169606 A1 | * 11/2015 | | A46B 5/0095 |

* cited by examiner

PERSONAL CARE DEVICE

CROSS REFERENCE TO RELATED APPLICATIONS

This application is the U.S. National Phase application under 35 U.S.C. § 371 of International Application No. PCT/EP2018/058976 filed Apr. 9, 2018, published as WO 2018/192788 on Oct. 25, 2018, which claims the benefit of European Patent Application Number 17000644.9 filed Apr. 17, 2017. These applications are hereby incorporated by reference herein.

FIELD OF THE INVENTION

The present invention relates to a personal care device for performing personal care operations on a subject and method for operating the personal care device.

BACKGROUND OF THE INVENTION

It is known to provide multi-purpose handheld personal care devices performing a combination of personal care operations such as cleaning, exfoliating, massaging, shaving, trimming, grooming, tooth brushing, eye energizing, etc. on the body of the subject. These personal care devices generally have an interchangeable treatment head and a driving unit to rotate and/or vibrate the treatment head for performing different personal care operations on the subject. Each of these treatment heads may have different working conditions for performing an individual operation on the skin or a body part of the subject. Accordingly, driving units should be driven in accordance with the requirement of the treatment head attached to the driving unit at that moment.

To provide this, some devices have selection buttons on the body of the personal care device to be activated by the user after changing the treatment head to ensure that the driving unit is controlled in a manner specific to the treatment head attached thereon. Alternatively, in some devices, body and treatment head communicate via a wireless communication pair such as RFID tag and NFC device. WO2015169606A1 discloses a body care device usable with plurality of interchangeable treatment heads to perform various skincare procedures on the subject. The device includes a sensor for detecting an individual treatment head when fitted to the device, by reading data from an RFID tag placed on the treatment head with the NFC device located in the body.

SUMMARY OF THE INVENTION

In a first aspect of the invention, a handheld personal care device (herein also indicated as "device") is presented. The device has a handheld body and a driving unit placed within the body. Driving unit includes a motor arrangement and a drive shaft one end of which is coupled to the motor arrangement. The other end of the drive shaft extends out of the body of the device and suitable to receive a treatment head for performing a personal care operation, especially a skin treatment or shaving operation, on the subject. A treatment head is detachably attachable to the free end of the driving unit. Treatment head may comprise an adapter for enabling the treatment head to be attached to the driving unit. For each individual personal care operation, different set of parameters is used for driving the treatment head. The device of the invention is suitable to be used together with at least two different treatment heads requiring different sets of parameters to perform different personal care operations on the subject. Treatment heads which are designated to be used with the device are configured to draw different levels of current from the motor when they are fitted on the driving unit and when they are in idle condition. In other words, when they are not loaded or not contacted with any other object such as the skin or a body part of the subject.

The device further comprises a sensor for measuring the current drawn from the motor during the operation of the motor. The driving unit and the sensor are controlled by a control unit. After the motor is activated, the sensor measures the motor current at a predefined measuring time (t1) and the control unit compares said measured motor current with at least one predefined current threshold (C) to identify the treatment head attached to the driving unit. Predefined measuring time (t1) is selected such that the measurement is performed right after the driving unit is activated and before the treatment head is exposed to a load. Properties of treatment heads that are suitable to be used with device are introduced into the control unit together with the required predefined current threshold(s) (C1, C2, . . . ). Levels of the amount of the current drawn by individual treatment heads are different from each other. Accordingly, predefined current threshold(s) (C1, C2, . . . ) can be selected so as to divide current measurement values into zones each of which are associated with a particular treatment head. Hence, each particular current value measured by the sensor at a predetermined measuring time (t1), falls into a particular zone determined by predefined current threshold(s) (C1, C2, . . . ) and points to a single treatment head to be selected as the identified treatment head fitted on the driving unit. Thus, control unit is enabled to decide which treatment head is fitted on the driving unit by evaluating the motor current value received from the sensor and predefined current thresholds (C1, C2, . . . ).

In an embodiment of the invention, each individual treatment head which is designated to be used with the device, is configured to draw an amount of current within specific predefined current ranges (R1, R2, . . . ) when treatment head is not subjected to any load. Predefined current ranges (R1, R2, . . . ) are selected such that they are not overlapping. In this embodiment, each predefined current threshold (C1, C2, . . . ) is selected from the values remaining between these predefined current ranges (R1, R2, . . . ). This selection would increase the reliability of treatment head identification process performed by the control unit.

The control unit has a memory for storing working parameters of the driving unit for each personal care operation to be performed by different treatment heads. When the fitted treatment head is identified, control unit retrieves working parameters associated with the fitted treatment head and applies to the driving unit at a predefined adapting time (t2) after the activation of the device. Using these tailored parameters for each treatment head would ensure that all personal care operations are performed on the body of the subject in an efficient manner. Besides, it is realized automatically without any user intervention.

In a preferred embodiment of the invention, the device is suitable to operate with two predefined treatment heads, namely shaver head and brush head. Shaver head is designed to remove hair from the skin of the subject and brush head is designed to perform skincare treatments such as cleansing, exfoliating, massaging, etc. on the skin of the subject. Shaver head and brush head have different working parameters and different physical properties. Accordingly, shaver head and brush head, when they are fitted to the driving unit and in idle condition, draw different amounts of current from the motor at a predetermined measuring time (t1) after the motor is activated. Specifically, the brush head is configured to draw an amount of current smaller than 340 mA and shaver head is adapted to draw an amount of current greater than 400 mA in said conditions. More specifically, measured current amount for the brush head is ranging between 210-340 mA (R1) and the measured current amount for the shaver head is ranging between 400-570 Ma (R2). Accordingly, the predefined current threshold (C) is selected from the range of 340-400 Ma for this specific embodiment. It is observed that the predefined current threshold (C) of 365 mA is far enough from upper and lower limits of allowed range to minimize the error occurrence and improve the reliability on treatment head identification process.

In this embodiment, predefined measuring time (t1) may be selected smaller than 500 ms. Specifically, 200 ms is chosen as the predefined measuring time (t1) to spare sufficient time for control unit to detect the treatment head fitted on the driving unit and adapt the working parameters associated with the detected treatment head before the treatment head is started to be used. In relation with the selected predefined measuring time (t1) above, predefined adaptation time (t2) is adapted to remain below 1000 ms. More specifically, predefined adaptation time (t2) is set to be realized as 500 ms to ensure that the adaptation of working parameters are completed before the first contact of the treatment head with the skin of the subject. Thus, all detection and adaptation processes are completed within the period between the activation of the personal care device and the first contact of treatment head with the subject, In an embodiment of the invention, warning means are included in the device. Warning means are configured to warn or notify the user about the detection of the treatment head or usability of the device. For the confirmation of the treatment head detection, an indicator may be included on the body in the form of a light and shows that the treatment head is detected properly. Alternatively, an alert may be included when the device is attempted to be used before the treatment head detection process is finalized. Such alert may be audial, visual or haptic feedback provided by the device. Hence, the treatment head identification process is ensured to be completed before the device is contacted with the skin or a body part of the subject.

In an embodiment of the invention, the motor configuration may comprise a first motor coupled to rotate the drive shaft, and a second motor that comprises a drive coil and a magnetic member configured to impart a vibratory motion to the drive shaft. This facilitates driving the treatment head fitted to the drive shaft in different individual personal care operations.

Alternative motor configurations to rotate and/or apply a vibratory motion to the drive shaft of the drive train can be used. For example, vibratory motion applied to the drive train need not necessarily be produced by a second motor and a mechanical arrangement may be provided so that on rotation of the shaft, it is subject to a hammer action to produce the vibratory motion. Also, a vibrating plate may be used to impart the vibratory motion to the shaft.

Either of the first and second motors can be used separately for the purpose of the invention. In other words, it is not necessary to include both motors to carry out the invention, a rotational motor alone or a vibratory motor alone is sufficient to perform all embodiments of the invention in the same way.

The working parameters can include the speed or direction of the rotation of the drive train, the frequency or amplitude of the vibratory motion of the driving unit, a modulation applied to the vibratory motion, or the duration of each of the personal care routine individually. These working parameters facilitate a wide range of personal care operations to be carried out for respective zones of the skin or a body part of the subject in dependence on the individual treatment head fitted to the driving unit to perform a particular personal care operation.

In a second aspect of the invention, a method for operating a personal care device is presented. The method comprises: activating the driving unit, measuring the motor current at a predefined measuring time (t1), comparing the measured motor current with the predefined current threshold(s) (C1, C2, . . . ), detecting the individual treatment head fitted on the driving unit.

In an embodiment of the invention, the method further comprises: retrieving the stored values of the working parameters for the detected treatment head from the memory, adapting the retrieved working parameters for the particular treatment head fitted to the driving unit at a predefined adapting time (t2).

Particular and preferred aspects of the invention are set out in the accompanying independent and dependent claims. Features from the dependent claims may be combined with features of the independent claims and with features of other dependent claims as appropriate and not merely as explicitly set out in the claims.

These and other aspects of the invention will be apparent from and elucidated with reference to the embodiment(s) described hereinafter.

BRIEF DESCRIPTION OF THE DRAWINGS

Embodiments of the invention will now be described, by way of example only, with reference to the accompanying drawings, in which.

Figure 1:
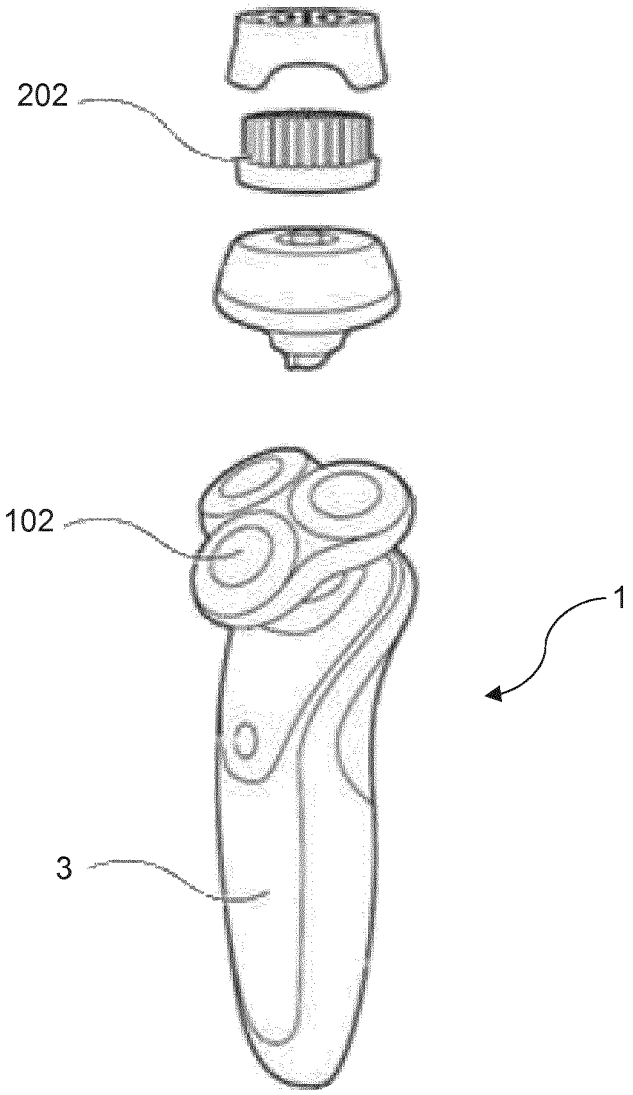
FIG. 1 is a schematic perspective view of a personal care device and two interchangable treatment heads one of which is coupled to the device in an embodiment.

The drawings are only schematic and are non-limiting. In the drawings, the size of some of the elements may be exaggerated and not drawn on scale for illustrative purposes.

Any reference signs in the claims shall not be construed as limiting the scope.

In the different drawings, the same reference signs refer to the same or analogous elements.

DETAILED DESCRIPTION OF EMBODIMENTS

Personal care device 1 is suitable for performing a skincare procedure on a subject, more specifically on a human body. The device 1 is suitable for uses such as cleansing, exfoliation, massaging, shaving, trimming, epilator or any other skincare related use. The device 1 is also suitable to be used with at least two interchangeable treatment heads each having different working conditions to perform different procedures on the body of the subject wherein only a single treatment head 2 can be attached to the device 1. This means that the device 1 itself comprises only one receiving port for receiving a treatment head 2. However, numerous number of interchangeable heads can be used together with the device 1 for different purposes as mentioned above. Treatment head 2 can be both rotary and vibratory.

FIG. 1 illustrates an embodiment of the personal care device 1. The device 1 comprises a handheld base body 3 and a driving unit 400 to receive and drive an interchangeable treatment head 2 to perform the personal care operation. Driving unit 400 includes a drive shaft 4 to receive the interchangeable treatment head 2 and a motor configuration 5, 6 to rotate the drive shaft 4 and/or apply a vibratory motion to the drive shaft 4. Driving unit 400 is located within the body 3 such that at least one end of the drive shaft 4 extends out of the body 3 to receive a treatment head 2.

The device 1 further comprises a sensor 7 for measuring the amount of current drawn from the motor arrangement 5,6 while the driving unit 400 is being operated. Said measurement is realized by sampling and averaging the motor current. The sensor 7 can be any type of sensor 7 that can be used to measure the current drawn from the motor. The device 1 also comprises a control unit 8 operably connected to the sensor 7 and the driving unit 400 and configured to control the driving unit 400. The control unit 8 have an access to measurement values from the sensor 7 and use these values for adjusting the working parameters of the driving unit 400.

The sensor 7 is configured to measure the motor current at a predefined measuring time (t1) after the activation of the driving unit 400 and the control unit 8 is configured to identify the individual treatment head 2 fitted on the driving unit 400 by comparing the measured motor current at the predefined measuring time (t1) with at least one predefined current threshold (C). Predefined measuring time (t1) is selected in a way to assure that no load is applied to the treatment head 2 yet. Predefined measuring time (t1) is between the activation of the device 1 and the first contact of the treatment head 2 with the skin of the subject.

Optionally, warning means is included in the device 1 to warn the user that the device 1 is not usable yet while the head detection process is continuing. Warning means may be audial such as an alarming voice and/or visual such as a warning light on the body 3 of the device 1. Alternatively, it may be a haptic feedback such that the device 1 vibrates.

In an embodiment of the invention, each individual treatment head suitable to be fitted to the driving unit 400 is configured to draw an amount of current within specific predefined current ranges (R1, R2, . . . ) which are not overlapping, at a predefined measuring time (t1) after the activation of the driving unit 400, when the individual treatment is fitted on the driving unit 400 and is in idle condition, and each predefined current threshold(s) (C1, C2, . . . ) is/are selected from the values remaining between these predefined current ranges (R1, R2, . . . ). The measurement made by the sensor 7 at predefined measuring time (t1) is expected to give values in different ranges for individual treatment heads. Depending on the working characteristics of the treatment heads selected to be used with the device 1, number of predefined current threshold (C) should be stored in the control unit 8.

In an embodiment of the invention, the device 1 is usable with three treatment heads all of which are expected to draw currents from the motor in different ranges which are not overlapping at the predefined measuring time (t1). In this case, two predefined current thresholds (C1,C2) is defined. In a more specific embodiment, three treatment heads are configured to draw a current in the ranges of R1: 100-200 mA, R2: 250-400 mA and R3: 450-700 mA at the predefined measuring time (t1) respectively. In this situation, two predefined current thresholds are selected as C1: 225 mA and C2: 425 mA respectively. Thus, the rule to identify the attached treatment head 2 is to compare the measured current value with the predefined current thresholds (C1,C2) and decide if the measured current value is smaller than the first predefined current threshold (C1) or greater than the second predefined current (C2) threshold or between the first predefined current threshold (C1) and second predefined current threshold (C2). For example, while one of those three treatment heads is attached on the device 1, when sensor 7 measures that 330 mA of current drawn from the motor at the predefined measuring time (t1), control unit 8 would identify that the second treatment head is attached since the measured value remains between the first predefined current threshold (225 mA) and second predefined current threshold (425 mA). This would facilitate the process of identifying the treatment head 2 attached to the driving unit 400.

Control unit 8 has a memory 9 with stored values for the working parameters of the driving unit 400 for each individual treatment head suitable to be fitted to the driving unit 400. Working parameters that are applied to the driving unit 400 may be different for each personal care operation performed by an individual treatment head. Some operations such as shaving requires higher rotation speed, longer operation duration while other operations such as cleansing and face massaging require lower rotation speed and shorter operation duration. All working parameters for all operations associated with the individual treatment heads are kept in the memory 9 and used when required. This facilitates the adjustment of the device 1 in dependence with the desired operation to be performed without any user input. Thus, optimal values tested by the manufacturer can be used any time without any additional effort by the user.

Optionally, user is allowed to edit working parameters based on his/her skin characteristics. This is realized either on the device 1 itself or on a mobile terminal such as mobile phone or tablet which is connectable to the device 1 and able to retrieve working parameters and allow users to edit thereof.

In an embodiment of the invention, the control unit 8 is configured to retrieve the stored values of the working parameters for the identified treatment head 2 from the memory 9, and control the driving unit 400 to perform the sequence of individual routines in accordance with the working parameters retrieved from the memory 9 for the particular treatment head. Upon the identification of the treatment head 2, control unit 8 retrieves and applies the working parameters associated with the detected treatment head 2. It facilitates to use the correct parameter for the individual personal care operation automatically.

When the motor 5,6 is first activated, the device 1 always starts working with parameters associated with the treatment head used at the latest session and eventually switch to the working parameters associated with the detected treatment head 2 fitted to the driving unit 400.

In an embodiment of the invention, control unit 8 is configured to adapt the working parameters for the identified treatment head 2 to the driving unit 400 at a predefined adapting time (t2) after the motor 5,6 is activated. Predefined adapting time (t2) is selected in a way to assure that no load is applied to the treatment head 2 at that time. Predefined adapting time (t2) should remain between the predefined measuring time (t1) and the first contact of the treatment head 2 with the skin or a body part of the subject. Optionally, warning means may be included in the device 1 to warn the user that the device 1 is not usable yet while the treatment head 2 adaptation process is ongoing. Accordingly, it is ensured that the device 1 is not used with wrong working parameters and thus potential injuries and/or performance issues would be prevented.

In a preferred embodiment of the invention, personal care device 1 is suitable to work with two interchangeable treatment heads one being the shaver head 102 for removing hair from the skin of the subject and the other being the brush head 202 for performing skincare treatments such as cleansing, exfoliating, massaging, etc. on the skin of the subject. The shaver head 102 is known to have a higher torque and hence higher current consumption level than the brush attachment. This would facilitate the identification of an individual treatment head 2 attached to the driving unit 400.

Figure 3:
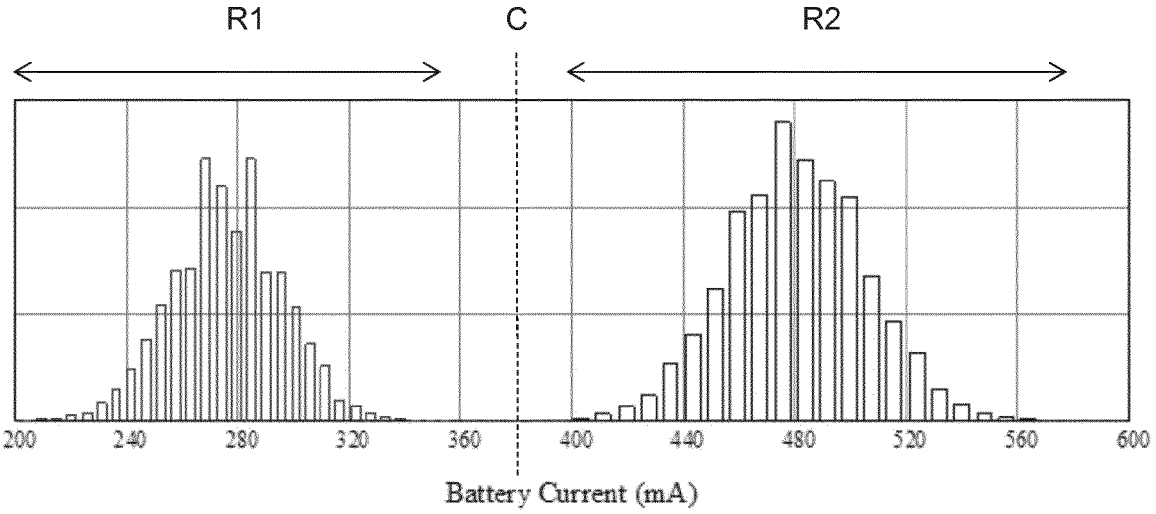
FIG. 3 is a histogram illustrating the motor current measurement values of treatment heads used in an embodiment.

In this embodiment, brush head 202 is configured to draw an amount of current smaller than 340 mA and shaver head 102 is adapted to draw an amount of current greater than 400 mA, when the treatment head is in idle condition, and wherein the predefined current threshold (C) is selected from the range of 340-400 mA. FIG. 3 shows a histogram of current amounts for the shaver head 102 and brush head 202 as a result of preliminary studies at a predefined measuring time (t1). As shown in FIG. 3, it is observed that the measured current amounts for the brush head 202 is ranging between 210-340 mA (R1) and the measured current amounts for the shaver head 102 is ranging between 400-570 mA (R2). Since the device 1 is suitable to be used with two treatment heads, only one predefined current threshold (C) which is selected between the upper limit of the lower range and the lower limit of the upper range is required. Accordingly, the predefined current threshold (C) is selected from the range of 340-400 mA for this specific embodiment. Further experiments show that, the predefined current threshold (C) of 365 mA is far from both ends of the allowable range and minimizes the possibility of error occurrence during the treatment head identification process.

In an embodiment of the invention, predefined measuring time (t1) is selected from the range of 0-500 ms. As mentioned above, predefined measuring time (t1) is selected in a way to assure that no load is applied to the treatment head 2 yet and predefined measuring time (t1) should remain between the activation of the device 1 and the first contact of the treatment head 2 with the skin or a body part of the subject. In a specific embodiment, predefined measuring time (t1) is selected as 200 ms. Hence, it is ensured that a sufficient time, for control unit 8 to identify the treatment head 2 and further adapting the working parameters associated with the identified treatment head 2, remains before the first contact of the treatment head 2 with the skin of the subject.

Similarly, predefined adaptation time (t2) is selected from the range of 0-1000 ms. In a specific embodiment, predefined adaptation time (t2) is configured as 500 ms.

Figure 2:
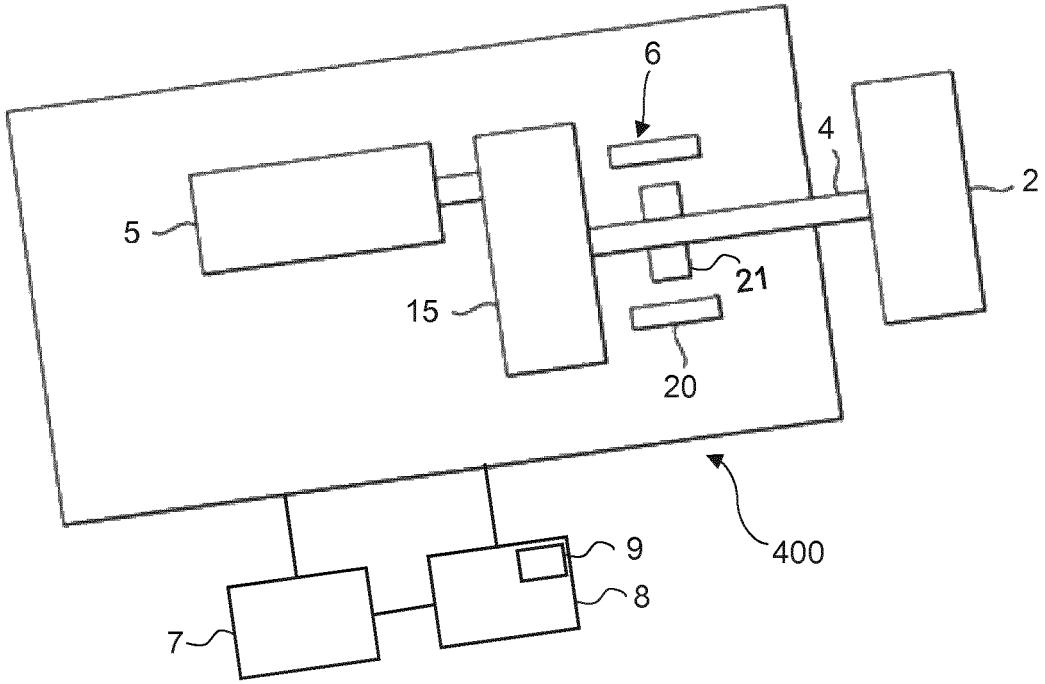
FIG. 2 is a sectional view of the control unit, sensor, driving unit and treatment head of the personal care device in an embodiment.

In an embodiment of the invention, the motor configuration comprises a first motor 5 coupled to rotate the drive shaft 4, and a second motor 6 that comprises a drive coil 20 and a magnetic member 21 configured to impart a vibratory motion to the drive shaft 4. Alternatively, motor configuration may also include a reduction gear (15) as illustrated in FIG. 2.

The second motor 6 imparts a longitudinal, axial, vibratory motion to the drive shaft 4, in addition to the rotation of the drive shaft 4 produced by the first motor 5. The second motor 6 includes a flux assembly or magnetic member 21 which cooperates with a drive coil 20 or solenoid that receives current from the microcontroller to impart a vibratory motion to the drive shaft 4.

Either of the first and second motors 5,6 can be used separately for the purpose of the invention. In other words, it is not necessary to include both motors to carry out the invention, a rotational motor 5 alone or a vibratory motor 6 alone is sufficient to perform all embodiments of the invention in the same way.

Alternative motor configurations to rotate and/or apply a vibratory motion to the drive shaft 4 of the driving unit 400 are possible. For example, the vibratory motion applied to the driving unit 400 need not necessarily be produced by the second motor 6. Instead, a mechanical arrangement may be provided so that on rotation of the drive shaft 4, it is subject to a hammer action axially so as to produce the vibratory motion. Alternatively, a vibrating plate may impart the vibratory motion to the drive shaft 4.

Working parameters include the rotation speed and/or rotation direction and/or operation duration of the driving unit 400 for each of the skincare routines in accordance with the particular treatment head 2. Working parameter may also include the frequency or amplitude of the vibratory motion of the driving unit 400. These working parameters facilitate a wide range of personal care operations to be carried out for respective zones of the skin or a body part of the subject in dependence on the individual treatment head 2 fitted to the driving unit 400 to perform a particular personal care operation.

Figure 4:
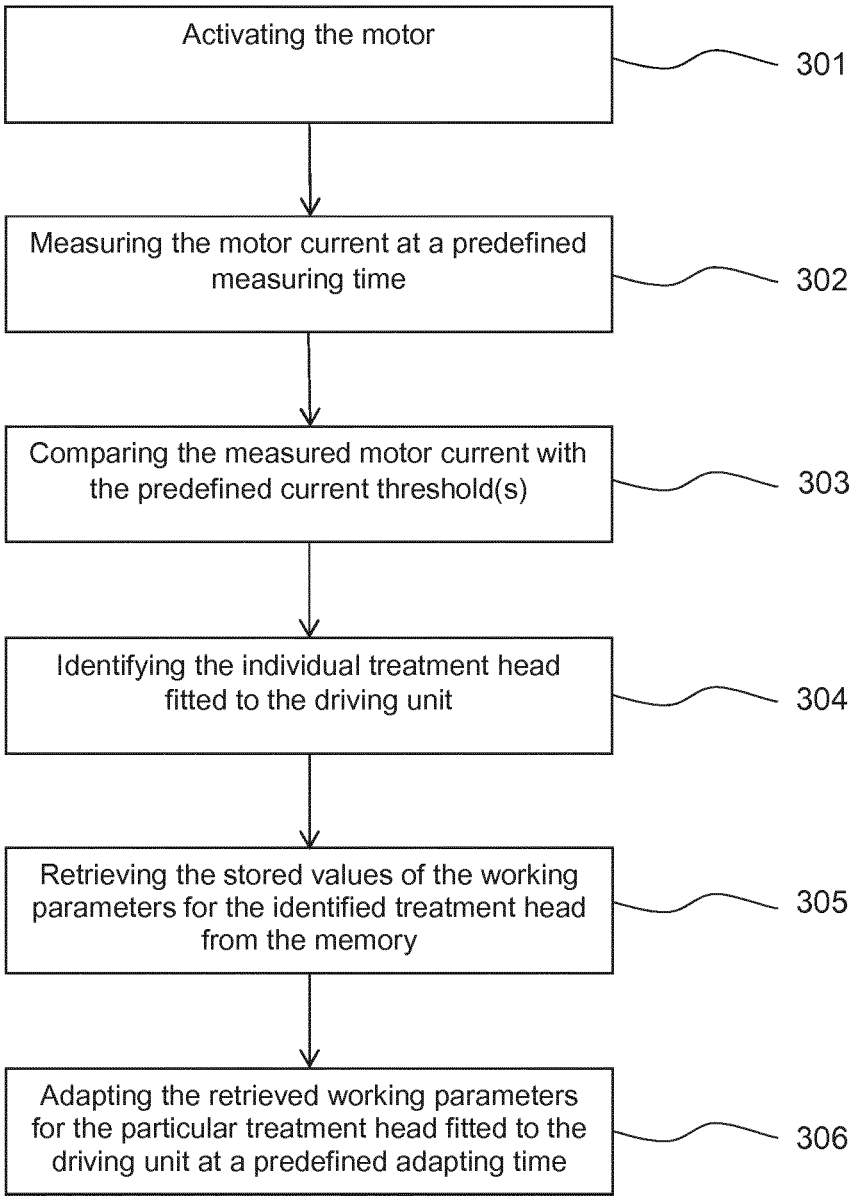
FIG. 4 is a flow chart illustrating a method of operating a personal care device.

FIG. 4 is a flow chart illustrating a method of operating a personal care device. In the first step, driving unit is activated 301. After a predefined measuring time (t1), in the next step, the motor current is measured 302. This motor current value is measured by the sensor 7. Next, the measured motor current is compared with the predefined current threshold(s) (C1, C2, . . . ) 303. Depending on the number of suitable interchangeable heads to be used together with the device 1, number of predefined current threshold(s) (C1, C2, . . . ) is varied. In the next step, individual treatment head fitted to the driving unit 400 would be identified by the control unit 8 as a result of the comparison of the measured motor current with the predefined current threshold(s) (C1, C2, . . . ) 304.

In the further steps, the stored values of the working parameters for the identified treatment head is retrieved from the memory 305 before being adapted to the driving unit 400 for the particular treatment head fitted to the driving unit 400 at a predefined adapting time (t2) 306. In a specific embodiment, predefined measuring time (t1) is selected as 200 ms and predefined adapting time (t2) is 500 ms.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, fig., or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

The invention claimed is:

1. A personal care device for performing personal care operations on a subject, comprising:

a handheld base body, a driving unit to receive and drive an interchangeable treatment head to perform the personal care operation, wherein the driving unit includes a drive shaft to receive the interchangeable treatment head and a motor configuration to rotate the drive shaft and/or apply a vibratory motion to the drive shaft;

a sensor for measuring the amount of current drawn from the motor arrangement while the driving unit is being operated;

a control unit operably connected to the sensor and the driving unit and configured to control the driving unit, wherein the sensor is configured to measure the motor current at a predefined measuring time after the activation of the driving unit and the control unit is configured to identify the individual treatment head fitted on the driving unit by comparing the measured motor current at the predefined measuring time with at least one predefined current threshold.

2. A personal care device as claimed in claim 1, wherein each individual treatment head suitable to be fitted to the driving unit is configured to draw an amount of current within specific predefined current ranges which are not overlapping, at a predefined measuring time after the activation of the driving unit, when the individual treatment is fitted on the driving unit and is in idle condition, and the at least one predefined current threshold is selected from the values remaining between these predefined current ranges.

3. A personal care device as claimed in claim 1, wherein the control unit has a memory with stored values for the working parameters of the driving unit for each individual treatment head suitable to be fitted to the driving unit.

4. A personal care device as claimed in claim 3, wherein the control unit is configured to retrieve the stored values of the working parameters for the identified treatment head from the memory, and control the driving unit to perform the sequence of individual routines in accordance with the working parameters retrieved from the memory for the particular treatment head.

5. A personal care device as claimed in claim 4, wherein the control unit is configured to adapt the working parameters for the identified treatment head to the driving unit at a predefined adapting time after the motor is activated.

6. A personal care device as claimed in claim 5, wherein the predefined adaptation time is selected from the range of 0-1000 ms.

7. A personal care device as claimed in claim 1, suitable to work with two interchangeable treatment heads one being a shaver head for removing hair from the skin of the subject and the other being a brush head for performing skincare treatments such as cleansing, exfoliating, massaging, etc. on the skin of the subject, wherein the brush head is configured to draw an amount of current smaller than 340 mA and shaver head is adapted to draw an amount of current greater than 400 mA, when the treatment head is in idle condition, and wherein the at least one predefined current threshold is selected from the range of 340-400 mA.

8. A personal care device as claimed in claim 7, wherein the at least one predefined current threshold is 365 mA.

9. A personal care device as claimed in claim 1, wherein the predefined measuring time is selected from the range of 0-500 ms.

10. A personal care device as claimed in claim 9, wherein the predefined measuring time is 200 ms.

11. A personal care device as claimed in claim 1, wherein the motor configuration comprises a first motor coupled to rotate the drive shaft, and a second motor that comprises a drive coil and a magnetic member configured to impart a vibratory motion to the drive shaft driving unit.

12. A personal care device as claimed in claim 1, wherein the working parameters include the rotation speed and/or rotation direction and/or operation duration of the driving unit for each of the personal care operations in accordance with the particular treatment head.

13. A method of operating a personal care device, the method comprising the following steps:

activating a driving unit, measuring a motor current at a predefined measuring time, comparing the measured motor current with at least one predefined current threshold, identifying an individual treatment head fitted to the driving unit.

14. The method according to claim 13, further comprises the following steps:

retrieving stored values of working parameters for the identified individual treatment head from a memory, adapting the retrieved working parameters for a particular treatment head fitted to the driving unit at a predefined adapting time.

* * * * *